US007097053B1

(12) United States Patent
Karl et al.

(10) Patent No.: US 7,097,053 B1
(45) Date of Patent: Aug. 29, 2006

(54) MATERIAL AND ARTICLE HOLDING RACK

(76) Inventors: Donald J. Karl, C1689 City Road P, Stratford, WI (US) 54484; Wandnetta Karl, C1689 City Road P, Stratford, WI (US) 54484

( * ) Notice: Subject to any disclaimer, the term of this patent is extended or adjusted under 35 U.S.C. 154(b) by 408 days.

(21) Appl. No.: 10/729,294

(22) Filed: Dec. 8, 2003

(51) Int. Cl.
*A47B 43/00* (2006.01)

(52) U.S. Cl. ..... 211/186

(58) Field of Classification Search ..... 211/186, 211/189, 187, 175, 198
See application file for complete search history.

(56) References Cited

U.S. PATENT DOCUMENTS 315,902 A 4/1885 Brown
1,737,315 A 11/1929 MacDonald
3,714,746 A 2/1973 Barlow
3,748,009 A 7/1973 Stone
4,133,148 A 1/1979 Swenumson
4,625,468 A 12/1986 Hampel
4,858,726 A 8/1989 Preston
4,984,399 A 1/1991 Taylor
5,555,679 A 9/1996 Scherba
6,595,145 B1 * 7/2003 Lietz ..... 108/149
6,955,130 B1 * 10/2005 Phillips ..... 108/96

* cited by examiner

*Primary Examiner*—Sarah Purol
(74) *Attorney, Agent, or Firm*—Donald R. Schoonover

(57) ABSTRACT

A material and article holding rack includes two levels wherein the top tier thereof can be moved to accommodate an object. An extension platform is included so articles are easily moved onto the top tier.

1 Claim, 2 Drawing Sheets

MATERIAL AND ARTICLE HOLDING RACK

TECHNICAL FIELD OF THE INVENTION

The present invention relates to the general art of material and article handling, and to the particular field of material and article handlers with a pivotable load receiving portion.

BACKGROUND OF THE INVENTION

Many homeowners have several pieces of equipment that must be stored in a storage space. This equipment includes lawn mowers, snowblowers, snowmobiles, and the like. This equipment is generally stored in a garage or a storage shed. However, with the proliferation of equipment, storage space becomes a premium. Shelves help, but do not solve the problem of storing large equipment, such as lawnmowers or the like.

Therefore, there is a need for a material and article handling rack that can be used to store equipment such as lawnmowers and the like.

Still further, moving heavy equipment such as a snowmobile may be cumbersome and difficult. Thus, even if there is room for storing such equipment, it may be difficult to maneuver the equipment into the storage space. This problem may be so acute that the storage space that is available may not be used in some instances. This problem may be especially acute if heavy equipment must be moved up a steep ramp onto the storage rack.

Therefore, there is a need for a material and article handling rack that can be used to store equipment such as lawnmowers and the like yet which is easily accessible for the stored equipment.

Sometimes, a single storage rack may be used for equipment of different sizes. In such a case, the storage rack must be re-configured to accommodate the equipment. Some presently known storage racks are not easily re-configured to accommodate a wide variety of equipment and thus may not be as versatile as possible. This may require a user to own several storage racks, which can be a costly and space consuming proposition.

Therefore, there is a need for a material and article handling rack that can be used to store equipment such as lawnmowers and the like yet which is easily re-configured as required.

There are racks and the like known in the art; however, these racks are not amenable to easy movement of a vehicle or other heavy object onto a top tier of the rack.

Therefore, there is a need for a material and article handling rack that can be used to store equipment such as lawnmowers and the like and which is amenable to accommodating a heavy object on a top tier of the rack.

PRINCIPAL OBJECTS OF THE INVENTION

It is a main object of the present invention to provide a material and article handling rack that can be used to store equipment such as lawnmowers and the like.

It is another object of the present invention to provide a material and article handling rack that can be used to store equipment such as lawnmowers and the like yet which is easily accessible for the stored equipment.

It is another object of the present invention to provide a material and article handling rack that can be used to store equipment such as lawnmowers and the like yet which is easily re-configured as required.

It is another object of the present invention to provide a material and article handling rack that can be used to store equipment such as lawnmowers and the like and which is amenable to accommodating a heavy object on a top tier of the rack.

SUMMARY OF THE INVENTION

These, and other, objects are achieved by a material and article holding rack which includes a top tier shelf that is longer than the frame unit of the rack and which can be pivoted from a tilted orientation to a level orientation using a winch. An extension platform is fixed to the top tier rack to further lessen the grade which must be traversed in order to place an object on the top tier rack. A bottom shelf fits snugly on the frame.

The material and article holding rack embodying the present invention thus can be modified and customized to accommodate the objects being stored and these objects are easily moved onto the top tier of the rack. The rack is easily configured to accommodate the objects being stored.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 1:
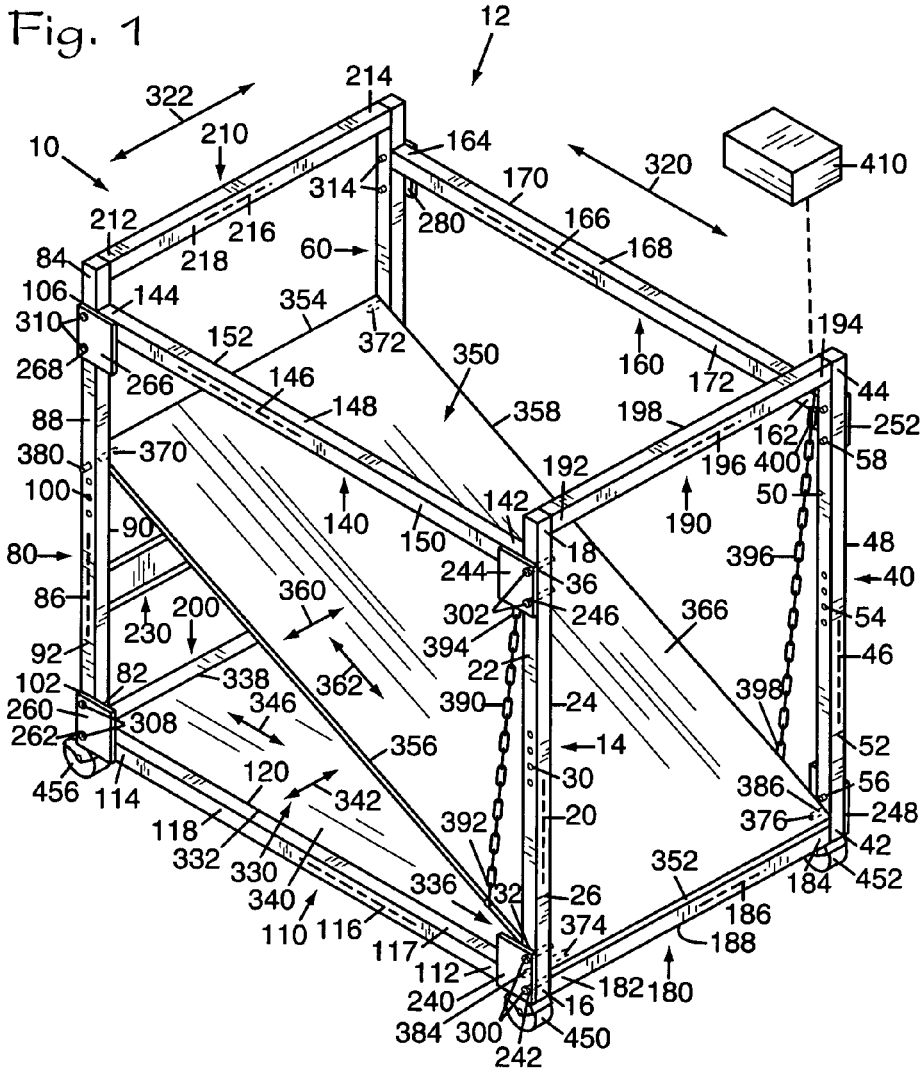
FIG. 1 is a perspective view of a material and article holding rack embodying the present invention.
Figure 4:
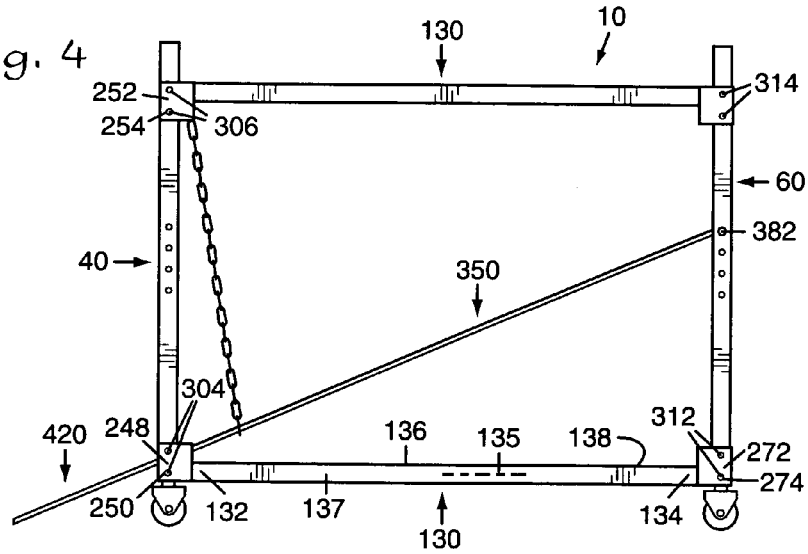
FIG. 4 is a side perspective view of a material and article holding rack with an extension platform in place.

Referring to the Figures, it can be understood that the present invention is embodied in a material and article holding rack 10 which is used to store objects such as lawnmowers, snowmobiles and the like. Rack 10 includes a frame unit 12 which can be formed of steel or the like. Frame unit 12 includes a first post 14 which is a first front end post when the frame unit 12 is in a use orientation as shown in FIGS. 1 and 4. First post 14 includes a first end 16 which is a bottom end when the frame unit 12 is in the use orientation, a second end 18 which is a top end when the frame unit 12 is in the use orientation, and a longitudinal axis 20 which extends between the first end 14 of the first post 14 and the second end 18 of the first post 14. The first post 14 further includes a first side 22, a second side 24, and a width dimension 26 which extends between the first side 22 of the first post 14 and the second side 24 of the first post 14. The width dimension 26 of the first post 14 extends transverse to the longitudinal axis 20 of the first post 14. A plurality of first fastener-accommodating holes 30 are defined from the first side 22 of the first post 14 to the second side 24 of the first post 14 in the direction of the width dimension 36 of the first post 14. The first fastener-accommodating holes 30 of the first post 14 are spaced apart from each other in the direction of the longitudinal axis 20 of the first post 14. A plurality of second fastener-accommodating holes 32 are defined from the first side 22 of the first post 14 to the second side 24 of the first post 14 in the direction of the width dimension 26 of the first post 14. The second fastener-accommodating holes 32 of the first post 14 are located adjacent to the first end 16 of the first post 14 and are spaced apart from each other in the direction of the longitudinal axis 20 of the first post 14. A plurality of third fastener-accommodating holes 36 are defined from the first side 22 of the first post 14 to the second side 24 of the first post 14 in the direction of the width dimension 26 of the first post 14. The third fastener-accommodating holes 36 of the first post 14 are located adjacent to the second end 18 of the first post 14 and are spaced apart from each other in the direction of the longitudinal axis 20 of the first post 14.

Frame unit 12 further includes a second post 40 which is a second front end post when the frame unit 12 is in the use orientation. The second post 40 includes a first end 42 which is a bottom end when the frame unit 12 is in the use orientation. A second end 44 is a top end when the frame unit 12 is in the use orientation. A longitudinal axis 46 extends between the first end 42 of the second post 40 and the second end 44 of the second post 40. Post 40 further includes a first side 48, a second side 50, and a width dimension 52 which extends between the first side 48 of the second post 40 and the second side 50 of the second post 40. The width dimension 52 of the second post 40 extends transverse to the longitudinal axis 46 of the second post 40. A plurality of first fastener-accommodating holes 54 are defined from the first side 48 of the second post 40 to the second side 50 of the second post 40 in the direction of the width dimension 52 of the second post 40. The first fastener-accommodating holes 54 of the second post 40 are spaced apart from each other in the direction of the longitudinal axis 46 of the second post 40. A plurality of second fastener-accommodating holes 56 are defined from the first side 48 of the second post 40 to the second side 50 of the second post 40 in the direction of the width dimension 52 of the second post 40. The second fastener-accommodating holes 56 of the second post 40 are located adjacent to the first end 42 of the second post 40 and are spaced apart from each other in the direction of the longitudinal axis 46 of the second post 40. A plurality of third fastener-accommodating holes 58 are defined from the first side 48 of the second post 40 to the second side 50 of the second post 40 in the direction of the width dimension 52 of the second post 40. The third fastener-accommodating holes 58 of the second post 40 are located adjacent to the second end 44 of the second post 40 and are spaced apart from each other in the direction of the longitudinal axis 46 of the second post 40.

Figure 2:
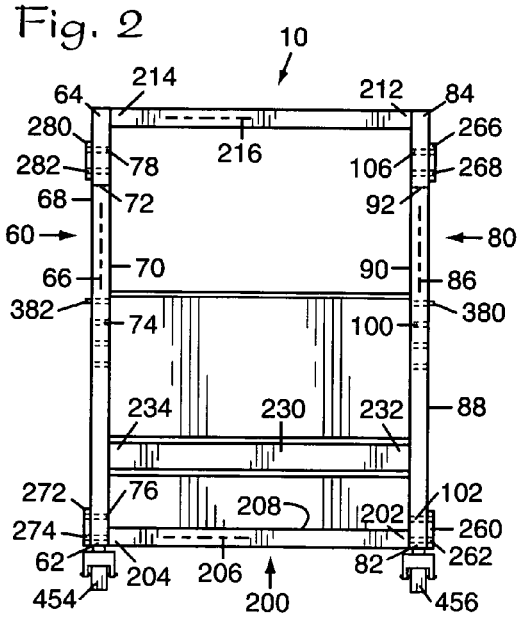
FIG. 2 is a rear end elevational view of the material and article holding rack shown in FIG. 1.

Frame unit 12 further includes a third post 60 which is shown in FIGS. 1 and 2 and which is a first rear end post when the frame unit 12 is in the use orientation. The third post 60 includes a first end 62 which is a bottom end when the frame unit 12 is in the use orientation. A second end 64 is a top end when the frame unit 12 is in the use orientation. A longitudinal axis 66 extends between the first end 62 of the third post 60 and the second end 64 of the third post 60. The third post 60 also includes a first side 68, a second side 70, and a width dimension 72 which extends between the first side 68 of the third post 60 and the second side 70 of the third post 60. The width dimension 72 of the third post 60 extends transverse to the longitudinal axis 66 of the third post 60. A plurality of first fastener-accommodating holes 74 are defined from the first side 68 of the third post 60 to the second side 70 of the third post 60 in the direction of the width dimension 72 of the third post 60. The first fastener-accommodating holes 74 of the third post 60 are spaced apart from each other in the direction of the longitudinal axis 66 of the third post 60. A plurality of second fastener-accommodating holes 76 are defined from the first side 68 of the third post 60 to the second side 70 of the third post 60 in the direction of the width dimension 72 of the third post 60, the second fastener-accommodating holes 76 of the third post 60 being located adjacent to the first end 62 of the third post 60 and are spaced apart from each other in the direction of the longitudinal axis 66 of the third post 60. A plurality of third fastener-accommodating holes 78 are defined from the first side 68 of the third post 60 to the second side 70 of the third post 60 in the direction of the width dimension 72 of the third post 60. The third fastener-accommodating holes 78 of the third post 60 are located adjacent to the second end 64 of the third post 60 and are spaced apart from each other in the direction of the longitudinal axis 66 of the third post 60.

Frame unit 12 further includes a fourth post 80 which is a second rear end post when the frame unit 12 is in the use orientation. The fourth post 80 includes a first end 82 which is a bottom end when the frame unit 12 is in the use orientation, a second end 84 which is a top end when the frame unit 12 is in the use orientation, and a longitudinal axis 86 which extends between the first end 82 of the fourth post 80 and the second end 84 of the fourth post 80. The fourth post 80 also includes a first side 88, a second side 90, and a width dimension 92 which extends between the first side 88 of the fourth post 80 and the second side 90 of the fourth post 80. The width dimension 92 of the fourth post 80 extends transverse to the longitudinal axis 86 of the fourth post 80. A plurality of first fastener-accommodating holes 100 are defined from the first side 88 of the fourth post 80 to the second side 90 of the fourth post 80 in the direction of the width dimension 92 of the fourth post 80. The first fastener-accommodating holes 100 of the fourth post 80 are spaced apart from each other in the direction of the longitudinal axis 86 of the fourth post 80. A plurality of second fastener-accommodating holes 102 are defined from the first side 88 of the fourth post 80 to the second side 90 of the fourth post 80 in the direction of the width dimension 92 of the fourth post 80. The second fastener-accommodating holes 102 of the fourth post 80 are located adjacent to the first end 82 of the fourth post 80 and are spaced apart from each other in the direction of the longitudinal axis 86 of the fourth post 80. A plurality of third fastener-accommodating holes 106 are defined from the first side 88 of the fourth post 80 to the second side 90 of the fourth post 80 in the direction of the width dimension 92 of the fourth post 80. The third fastener-accommodating holes 106 of the fourth post 80 are located adjacent to the second end 84 of the fourth post 80 and are spaced apart from each other in the direction of the longitudinal axis 86 of the fourth post 80.

Frame unit 12 further includes a first side beam 110 which is a bottom beam when the frame unit 12 is in the use orientation. The first side beam 110 includes a first end 112 which is located adjacent to the first end 16 of the first post 14, a second end 114 which is located adjacent to the first end 82 of the fourth post 80, and a longitudinal axis 116 which extends between the first end 112 of the first side beam 110 and the second end 114 of the first side beam 110. The first side beam 110 also includes a first surface 117 which is a top surface when the frame unit 12 is in the use orientation, a first side surface 118, and a second surface 120.

Frame unit 12 further includes a second side beam 130 which is a bottom beam when the frame unit 12 is in the use orientation. The second side beam 130 includes a first end 132 which is located adjacent to the first end 42 of the second post 40, a second end 134 which is located adjacent to the first end 62 of the third post 60, and a longitudinal axis which extends between the first end 132 of the second side beam 130 and the second end 134 of the second side beam 130. Side beam 130 further includes a first surface 136 which is a top surface when the frame unit 12 is in the use orientation, a first side surface 137, and a second side surface 138.

Frame unit 12 further includes a third side beam 140 which is a top beam when the frame unit 12 is in the use orientation. The third side beam 140 includes a first end 142 which is located adjacent to the second end 18 of the first post 14, a second end 144 which is located adjacent to the second end 84 of the fourth post 80, and a longitudinal axis 146 which extends between the first end 142 of the third side beam 140 and the second end 144 of the third side beam 140. Side beam 140 also includes a first surface 148 which is a top surface when the frame unit 12 is in the use orientation, a first side surface 150, and a second surface 152.

Frame unit 12 further includes a fourth side beam 160 which is a top beam when the frame unit 12 is in the use orientation. The fourth side beam 160 includes a first end 162 which is located adjacent to the second end 44 of the second post 40, a second end 164 which is located adjacent to the second end 64 of the third post 60, and a longitudinal axis 166 which extends between the first end 162 of the fourth side beam 160 and the second end 164 of the fourth side beam 160. Side beam 160 also includes a first surface 168 which is a top surface when the frame unit 12 is in the use orientation, a first side surface 170, and a second surface 172.

Frame unit 12 further includes a first cross beam 180 which is a bottom beam when the frame unit 12 is in the use orientation. The first cross beam 180 includes a first end 182 fixed to the first end 16 of the first post 14, a second end 184 fixed to the first end 42 of the second post 40, and a longitudinal axis 186 which extends between the first end 182 of the first cross beam 180 and the second end 184 of the first cross beam 180. Cross beam 180 also includes a first surface 188.

Frame unit 12 further includes a second cross beam 190 which is a top beam when the frame unit 12 is in the use orientation. The second cross beam 190 includes a first end 192 fixed to the second end 18 of the first post 14, a second end 194 fixed to the second end 44 of the second post 40, a longitudinal axis 196 which extends between the first end 192 of the second cross beam 190 and the second end 194 of the second cross beam 190, and a first surface 198.

Frame unit 12 further includes a third cross beam 200 which is a bottom beam when the frame unit 12 is in the use orientation. The third cross beam 200 includes a first end 202 fixed to the first end 82 of the fourth post 80, a second end 204 fixed to the first end 62 of the third post 60, a longitudinal axis 206 which extends between the first end 202 of the third cross beam 200 and the second end 204 of the third cross beam 200, and a first surface 208.

Frame unit 12 further includes a fourth cross beam 210 which is a top beam when the frame unit 12 is in the use orientation. The fourth cross beam 210 includes a first end 212 fixed to the second end 84 of the fourth post 80, a second end 214 fixed to the second end 64 of the third post 60, a longitudinal axis 216 which extends between the first end 212 of the fourth cross beam 210 and the second end 214 of the fourth cross beam 210, and a first surface 218.

Frame unit 12 further includes a support beam 230 which has a first end 232 fixed to the fourth post 80 and a second end 234 fixed to the third post 60.

Frame unit 12 further includes a first fastener plate 240 fixed to the first side surface 118 of the first side beam 110 adjacent to the first end 112 of the first side beam 110. The first fastener plate 240 includes two fastener-accommodating holes 242 defined there-through.

Further fastener plates include: a second fastener plate 244 fixed to the first side surface 150 of the third side beam 140 adjacent to the first end 142 of the third side beam 140, the second fastener plate 244 including two fastener-accommodating holes 246 defined therethrough; a third fastener plate 248 fixed to the first side surface 137 of the second side beam 130 adjacent to the first end 132 of the second side beam 130, the third fastener plate 248 including two fastener-accommodating holes 250 defined therethrough; a fourth fastener plate 252 fixed to the first side surface 170 of the fourth side beam 160 adjacent to the first end 162 of the fourth side beam 160, the fourth fastener plate 252 including two fastener-accommodating holes 254 defined there-through; a fifth fastener plate 260 fixed to the first side surface 118 of the first side beam 110 adjacent to the second end 184 of the first cross beam, the fifth fastener plate 260 including two fastener-accommodating holes 262 defined therethrough; a sixth fastener plate 266 fixed to the first side surface 150 of the third side beam 140 adjacent to the second end 144 of the third side beam 140, the sixth fastener plate 266 including two fastener-accommodating holes 268 defined therethrough; a seventh fastener plate 272 fixed to the first side surface 137 of the second side beam 130 adjacent to the second end 134 of the second side beam 130, the seventh fastener plate 272 including two fastener-accommodating holes 274 defined therethrough; and an eighth fastener plate 280 fixed to the first side surface 170 of the fourth side beam 160 adjacent to the second end 164 of the fourth side beam 160, the eighth fastener plate 280 including two fastener-accommodating holes 282 defined there-through.

Frame unit 12 further includes two fasteners which extend through each fastener plate. The fasteners include: two fasteners 300 which extend through the fastener-accommodating holes 242 defined through the first fastener plate 240 into the second fastener-accommodating holes 32 of the first post 14 and fixing the first fastener plate 240 to the first post 14; two fasteners 302 which extend through the fastener-accommodating holes 246 defined through the second fastener plate 244 into the third fastener-accommodating holes 36 of the first post 14 and fix the second fastener plate 244 to the first post 14; two fasteners 304 which extend through the fastener-accommodating holes 250 defined through the third fastener plate 248 into the second fastener-accommodating holes 56 of the second post 40 and fix the third fastener plate 248 to the second post 40; two fasteners 306 which extend through the fastener-accommodating holes 254 defined through the fourth fastener plate 252 into the third fastener-accommodating holes 58 of the second post 40 and fix the fourth fastener plate 252 to the second post 40; two fasteners 308 which extend through the fastener-accommodating holes 262 defined through the fifth fastener plate 260 into the second fastener-accommodating holes 102 of the fourth post 80 and fix the fifth fastener plate 260 to the fourth post 80; two fasteners 310 which extend through the fastener-accommodating holes 268 defined through the sixth fastener plate 266 into the third fastener-accommodating holes 106 of the fourth post 80 and fix the sixth fastener plate 206 to the fourth post 80; two fasteners 312 which extend through the fastener-accommodating holes 274 defined through the seventh fastener plate 272 into the second fastener-accommodating holes 76 of the third post 60 and fix the seventh fastener plate 272 to the third post 60; and two fasteners 314 which extend through the fastener-accommodating holes 282 defined through the eighth fastener plate 280 into the third fastener-accommodating holes 78 of the third post 60 and fix the eighth fastener plate 280 to the third post 60.

Frame unit 12 has a length dimension 320 which is measured between the first surface 188 of the first cross beam 180 and the first surface 208 of the third cross beam 200 in the direction of the longitudinal axis 116 of the first side beam 110, and a width dimension 322 measured between the second surface 120 of the first side beam 110 and the second surface 138 of the second side beam 130 in the direction of the longitudinal axis 186 of the first cross beam 180.

A first tier shelf 330 includes a first side edge 332 fixed to the second surface 120 of the first side beam 110, a second side edge 334 fixed to the second surface 138 of the second side beam 130, a first end edge 336 fixed to the first surface 188 of the first cross beam 180, a second end edge 338 fixed to the first surface 208 of the third cross beam 200, and a first surface 340 which is a top surface when the first tier shelf 330 is in a use orientation as shown in FIG. 1. The first tier shelf 330 also includes a width dimension 342 that extends between the first side edge 332 of the first tier shelf 330 and the second side edge 334 of the first tier shelf 330. The width dimension 342 of the first tier shelf 330 is equal to the width dimension 26 of the frame unit 12 so the first tier shelf 330 is snugly and securely held in place on the frame unit 12. A length dimension 346 extends between the first end edge 336 of the first tier shelf 330 and the second end edge 338 of the first tier shelf 330. The length dimension 346 of the first tier shelf 330 is equal to the length dimension of the frame unit 12 so the first tier shelf 330 is securely mounted on the frame unit 12.

A top tier shelf 350 includes a first end edge 352, a second end edge 354, a first side edge 356, a second side edge 358, and a width dimension 360 which extends between the first side edge 356 of the top tier shelf 350 and the second side edge 358 of the top tier shelf 350. The width dimension 360 of the top tier shelf 350 is equal to the width dimension 26 of the frame unit 12. The top tier shelf 350 further includes a length dimension 362 which extends between the first end edge 352 of the top tier shelf 350 and the second end edge 354 of the top tier shelf 350. The length dimension 362 of the top tier shelf 350 is greater than the length dimension of the frame unit 12. The extra length permits the top tier 350 to be angled as shown in FIG. 1 so a heavy object can be easily moved onto the top tier 350. The top tier shelf 350 further includes a first surface 366 which is a top surface when the top tier shelf 350 is in a use orientation.

Fastener-accommodating holes are defined in the top tier shelf 350 and include: a first fastener-accommodating hole 370 defined in the top tier shelf 350 through the first side edge 356 of the top tier shelf 350 adjacent to the second end edge 354 of the top tier shelf 350; a second fastener-accommodating hole 372 defined in the top tier shelf 350 through the second side edge 358 of the top tier shelf 350 adjacent to the second end edge 354 of the top tier shelf 350; a third fastener-accommodating hole 374 defined in the top tier shelf 350 through the first side edge 356 of the top tier shelf 350 near and spaced apart from the first end edge 352 of the top tier shelf 350; and a fourth fastener-accommodating hole 376 defined in the top tier shelf 350 through the second side edge 358 of the top tier shelf 350 near and spaced apart from the first end edge 352 of the top tier shelf 350.

Fasteners are accommodated in the fastener-accommodating holes in the fastener plates and in the top tier shelf 350 to attach the top tier shelf 350 to the frame unit 12 as shown in FIG. 1. These fasteners include: a first fastener 380 accommodated through one fastener-accommodating hole of the plurality of first fastener-accommodating holes 100 in the fourth post 80, with first fastener 380 pivotally attaching the top tier shelf 350 to the fourth post 80; a second fastener 382 accommodated through one fastener-accommodating hole of the plurality of first fastener-accommodating holes 74 in the third post 60, the second fastener 382 pivotally attaching the top tier shelf 350 to the third post 60; a third fastener 384 accommodated through one fastener-accommodating hole of the plurality first fastener-accommodating holes 30 in the first post 14, the third fastener 384 being accommodated in the third fastener-accommodating hole 374 defined in the top tier shelf 350 and attaching the top tier shelf 350 to the first post 14; and a fourth fastener 386 accommodated through one fastener-accommodating hole of the plurality of first fastener-accommodating holes 54 in the second post 40, the fourth fastener 386 being accommodated in the fourth fastener-accommodating hole 376 defined in the top tier shelf 350 and attaching the top tier shelf 350 to the second post 40.

A first support chain 390 has a first end 392 fixed to the first side edge 356 of the top tier shelf 350 and a second end 394. A second support chain 396 has a first end 398 fixed to the second side edge 358 of the top tier shelf 350 and a second end 400.

A winding winch unit 410 is mounted on the frame unit 12 and is connected to the first support chain 390 and to the second support chain 396. The winding wench unit 410 is well known to those skilled in the art and thus will not be further described.

Figure 3:
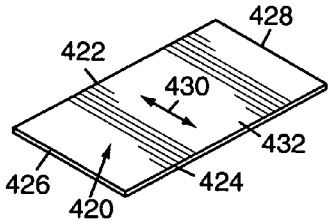
FIG. 3 is a perspective view of an extension platform that is used to assist movement of objects onto a top tier of the material and article holder rack shown in FIG. 1.

An extension platform 420 is shown in FIGS. 3 and 4 and includes a first side edge 422, a second side edge 424, a first end edge 426, a second end edge 428, and a width dimension 430 measured between the first side edge 422 of the extension platform 420 and the second side edge 424 of the extension platform 420. The width dimension 430 of the extension platform 420 is equal to the width dimension 360 of the top tier shelf 350. The extension platform 420 further includes a first surface 432 which is a top surface when the extension platform 420 is in the use orientation as shown in FIGS. 3 and 4.

The first end edge 426 of the extension platform 420 is fixedly connected to the first end edge 352 of the top tier shelf 350 when the extension platform 420 is in the use orientation as shown in FIG. 4. The extension platform 420 permits a heavy object to be gradually moved onto the top tier shelf 350 so the incline up which the object must be pushed is as gradual as possible.

A plurality of support wheels include: a first support wheel 450 on the first end 16 of the first post 14 of the frame unit 12, a second support wheel 452 on the first end 42 of the second post 40 of the frame unit 12, a third support wheel 454 on the first end 62 of the third post 60 of the frame unit 12, and a fourth support wheel 456 on the first end 82 of the fourth post 80 of the frame unit 12.

Use of rack 10 will be understood from the foregoing. However, it is noted that the extension platform 420 is used to permit heavy objects to be pushed up a gradual incline onto the top tier shelf 350 thereby making use of rack 10 easy. The top tier shelf 350 is oriented as shown in FIG. 1 for an object to be loaded thereon, and the winch 410 is operated to move the top tier shelf 350 into a level orientation. Another object can then be loaded onto the bottom shelf 330 and the rack 10 moved on its wheels to a convenient location.

It is understood that while certain forms of the present invention have been illustrated and described herein, it is not to be limited to the specific forms or arrangements of parts described and shown.

What is claimed and desired to be covered by Letters Patent is as follows:

1. A material and article holding rack comprising:

a) a frame unit which includes (1) a first post which is a first front end post when said frame unit is in a use orientation, the first post including a first end which is a bottom end when said frame unit is in the use orientation, a second end which is a top end when said frame unit is in the use orientation, a longitudinal axis extending between the first end of the first post and the second end of the first post, a first side, a second side, a width dimension which extends between the first side of the first post and the second side of the first post, the width dimension of the first post extending transverse to the longitudinal axis of the first post, a plurality of first fastener-accommodating holes defined from the first side of the first post to the second side of the first post in the direction of the width dimension of the first post, the first fastener-accommodating holes of the first post being spaced apart from each other in the direction of the longitudinal axis of the first post, a plurality of second fastener-accommodating holes defined from the first side of the first post to the second side of the first post in the direction of the width dimension of the first post, the second fastener-accommodating holes of the first post being located adjacent to the first end of the first post and being spaced apart from each other in the direction of the longitudinal axis of the first post, a plurality of third fastener-accommodating holes defined from the first side of the first post to the second side of the first post in the direction of the width dimension of the first post, the third fastener-accommodating holes of the first post being located adjacent to the second end of the first post and being spaced apart from each other in the direction of the longitudinal axis of the first post, (2) a second post which is a second front end post when said frame unit is in the use orientation, the second post including a first end which is a bottom end when said frame unit is in the use orientation, a second end which is a top end when said frame unit is in the use orientation, a longitudinal axis extending between the first end of the second post and the second end of the second post, a first side, a second side, a width dimension which extends between the first side of the second post and the second side of the second post, the width dimension of the second post extending transverse to the longitudinal axis of the second post, a plurality of first fastener accommodating holes defined from the first side of the second post to the second side of the second post in the direction of the width dimension of the second post, the first fastener-accommodating holes of the second post being spaced apart from each other in the direction of the longitudinal axis of the second post, a plurality of second fastener-accommodating holes defined from the first side of the second post to the second side of the second post in the direction of the width dimension of the second post, the second fastener-accommodating holes of the second post being located adjacent to the first end of the second post and being spaced apart from each other in the direction of the longitudinal axis of the second post, a plurality of third fastener-accommodating holes defined from the first side of the second post to the second side of the second post in the direction of the width dimension of the second post, the third fastener-accommodating holes of the second post being located adjacent to the second end of the second post and being spaced apart from each other in the direction of the longitudinal axis of the second post, (3) a third post which is a first rear end post when said frame unit is in the use orientation, the third post including a first end which is a bottom end when said frame unit is in the use orientation, a second end which is a top end when said frame unit is in the use orientation, a longitudinal axis extending between the first end of the third post and the second end of the third post, a first side, a second side, a width dimension which extends between the first side of the third post and the second side of the third post, the width dimension of the third post extending transverse to the longitudinal axis of the third post, a plurality of first fastener-accommodating holes defined from the first side of the third post to the second side of the third post in the direction of the width dimension of the third post, the first fastener-accommodating holes of the third post being spaced apart from each other in the direction of the longitudinal axis of the third post, a plurality of second fastener-accommodating holes defined from the first side of the third post to the second side of the third post in the direction of the width dimension of the third post, the second fastener-accommodating holes of the third post being located adjacent to the first end of the third post and being spaced apart from each other in the direction of the longitudinal axis of the third post, a plurality of third fastener-accommodating holes defined from the first side of the third post to the second side of the third post in the direction of the width dimension of the third post, the third fastener-accommodating holes of the third post being located adjacent to the second end of the third post and being spaced apart from each other in the direction of the longitudinal axis of the third post, (4) a fourth post which is a second rear end post when said frame unit is in the use orientation, the fourth post including a first end which is a bottom end when said frame unit is in the use orientation, a second end which is a top end when said frame unit is in the use orientation, a longitudinal axis extending between the first end of the fourth post and the second end of the fourth post, a first side, a second side, a width dimension which extends between the first side of the fourth post and the second side of the fourth post, the width dimension of the fourth post extending transverse to the longitudinal axis of the fourth post, a plurality of first fastener-accommodating holes defined from the first side of the fourth post to the second side of the fourth post in the direction of the width dimension of the fourth post, the first fastener-accommodating holes of the fourth post being spaced apart from each other in the direction of the longitudinal axis of the fourth post, a plurality of second fastener-accommodating holes defined from the first side of the fourth post to the second side of the fourth post in the direction of the width dimension of the fourth post, the second fastener-accommodating holes of the fourth post being located adjacent to the first end of the fourth post and being spaced apart from each other in the direction of the longitudinal axis of the fourth post, a plurality of third fastener-accommodating holes defined from the first side of the fourth post to the second side of the fourth post in the direction of the width dimension of the fourth post, the third fastener-accommodating holes of the fourth post being located adjacent to the second end of the fourth post and being spaced apart from each other in the direction of the longitudinal axis of the fourth post, (5) a first side beam which is a bottom beam when said frame unit is in the use orientation, the first side beam including a first end which is located adjacent to the first end of the first post, a second end which is located adjacent to the first end of the fourth post, a longitudinal axis which extends between the first end of the first side beam and the second end of the first side beam, a first surface which is a top surface when said frame unit is in the use orientation, a first side surface, and a second surface, (6) a second side beam which is a bottom beam when said frame unit is in the use orientation, the second side beam including a first end which is located adjacent to the first end of the second post, a second end which is located adjacent to the first end of the third post, a longitudinal axis which extends between the first end of the second side beam and the second end of the second side beam, a first surface which is a top surface when said frame unit is in the use orientation, a first side surface, and a second side surface, (7) a third side beam which is a top beam when said frame unit is in the use orientation, the third side beam including a first end which is located adjacent to the second end of the first post, a second end which is located adjacent to the second end of the fourth post, a longitudinal axis which extends between the first end of the third side beam and the second end of the third side beam, a first surface which is a top surface when said frame unit is in the use orientation, a first side surface, and a second surface, (8) a fourth side beam which is a top beam when said frame unit is in the use orientation, the fourth side beam including a first end which is located adjacent to the second end of the second post, a second end which is located adjacent to the second end of the third post, a longitudinal axis which extends between the first end of the fourth side beam and the second end of the fourth side beam, a first surface which is a top surface when said frame unit is in the use orientation, a first side surface, and a second surface, (9) a first cross beam which is a bottom beam when said frame unit is in the use orientation, the first cross beam including a first end fixed to the first end of the first post, a second end fixed to the first end of the second post, a longitudinal axis extending between the first end of the first cross beam and the second end of the first cross beam, and a first surface,

(10) a second cross beam which is a top beam when said frame unit is in the use orientation, the second cross beam including a first end fixed to the second end of the first post, a second end fixed to the second end of the second post, a longitudinal axis extending between the first end of the second cross beam and the second end of the second cross beam, and a first surface,

(11) a third cross beam which is a bottom beam when said frame unit is in the use orientation, the third cross beam including a first end fixed to the first end of the fourth post, a second end fixed to the first end of the third post, a longitudinal axis extending between the first end of the third cross beam and the second end of the third cross beam, and a first surface,

(12) a fourth cross beam which is a top beam when said frame unit is in the use orientation, the fourth cross beam including a first end fixed to the second end of the fourth post, a second end fixed to the second end of the third post, a longitudinal axis extending between the first end of the fourth cross beam and the second end of the fourth cross beam, and a first surface,

(13) a support beam having a first end fixed to the fourth post and a second end fixed to the third post,

(14) a first fastener plate fixed to the first side surface of the first side beam adjacent to the first end of the first side beam, the first fastener plate including two fastener-accommodating holes defined therethrough,

(15) a second fastener plate fixed to the first side surface of the third side beam adjacent to the first end of the third side beam, the second fastener plate including two fastener-accommodating holes defined therethrough,

(16) a third fastener plate fixed to the first side surface of the second side beam adjacent to the first end of the second side beam, the third fastener plate including two fastener-accommodating holes defined therethrough,

(17) a fourth fastener plate fixed to the first side surface of the fourth side beam adjacent to the first end of the fourth side beam, the fourth fastener plate including two fastener-accommodating holes defined therethrough,

(18) a fifth fastener plate fixed to the first side surface of the first side beam adjacent to the second end of the first cross beam, the fifth fastener plate including two fastener-accommodating holes defined therethrough,

(19) a sixth fastener plate fixed to the first side surface of the third side beam adjacent to the second end of the third side beam, the sixth fastener plate including two fastener-accommodating holes defined therethrough,

(20) a seventh fastener plate fixed to the first side surface of the second side beam adjacent to the second end of the second side beam, the seventh fastener plate including two fastener-accommodating holes defined therethrough,

(21) an eighth fastener plate fixed to the first side surface of the fourth side beam adjacent to the second end of the fourth side beam, the eighth fastener plate including two fastener-accommodating holes defined therethrough,

(22) two fasteners extending through the fastener-accommodating holes defined through the first fastener plate into the second fastener-accommodating holes of the first post and fixing the first fastener plate to the first post,

(23) two fasteners extending through the fastener-accommodating holes defined through the second fastener plate into the third fastener-accommodating holes of the first post and fixing the second fastener plate to the first post,

(24) two fasteners extending through the fastener-accommodating holes defined through the third fastener plate into the second fastener-accommodating holes of the second post and fixing the third fastener plate to the third post,

(25) two fasteners extending through the fastener-accommodating holes defined through the fourth fastener plate into the third fastener-accommodating holes of the second post and fixing the fourth fastener plate to the second post,

(26) two fasteners extending through the fastener-accommodating holes defined through the fifth fastener plate into the second fastener-accommodating holes of the fourth post and fixing the fifth fastener plate to the fourth post,

(27) two fasteners extending through the fastener-accommodating holes defined through the sixth fastener plate into the third fastener-accommodating holes of the fourth post and fixing the sixth fastener plate to the fourth post,

(28) two fasteners extending through the fastener-accommodating holes defined through the seventh fastener plate into the second fastener-accommodating holes of the third post and fixing the seventh fastener plate to the third post,

(29) two fasteners extending through the fastener-accommodating holes defined through the eighth fastener plate into the third fastener-accommodating holes of the third post and fixing the eighth fastener plate to the third post,

(30) said frame unit having a length dimension measured between the first surface of the first cross beam and the first surface of the third cross beam in the direction of the longitudinal axis of the first side beam, and

(31) said frame unit having a width dimension measured between the second surface of the first side beam and the second surface of the second side beam in the direction of the longitudinal axis of the first cross beam;

b) a first tier shelf which includes (1) a first side edge fixed to the second surface of the first side beam, (2) a second side edge fixed to the second surface of the second side beam, (3) a first end edge fixed to the first surface of the first cross beam, (4) a second end edge fixed to the first surface of the third cross beam, (5) a first surface which is a top surface when said first tier shelf is in a use orientation, (6) a width dimension that extends between the first side edge of said first tier shelf and the second side edge of said first tier shelf, the width dimension of said first tier shelf being equal to the width dimension of said frame unit, and (7) a length dimension that extends between the first end edge of said first tier self and the second end edge of said first tier shelf, the length dimension of said first tier shelf being equal to the length dimension of said frame unit;

c) a top tier shelf which includes (1) a first end edge, (2) a second end edge, (3) a first side edge, (4) a second side edge, (5) a width dimension which extends between the first side edge of said top tier shelf and the second side edge of said top tier shelf, the width dimension of said top tier shelf being equal to the width dimension of said frame unit, (6) a length dimension which extends between the first end edge of said top tier shelf and the second end edge of said top tier shelf, the length dimension of said top tier shelf being greater than the length dimension of said frame unit, (7) a first surface which is a top surface when said top tier shelf is in a use orientation, (8) a first fastener-accommodating hole defined in said top tier shelf through the first side edge of said top tier shelf adjacent to the second end edge of said top tier shelf, (9) a second fastener-accommodating hole defined in said top tier shelf through the second side edge of said top tier shelf adjacent to the second end edge of said top tier shelf,

(10) a third fastener-accommodating hole defined in said top tier shelf through the first side edge of said top tier shelf near and spaced apart from the first end edge of said top tier shelf, and

(11) a fourth fastener-accommodating hole defined in said top tier shelf through the second side edge of said top tier shelf near and spaced apart from the first end edge of said top tier shelf;

d) a first fastener accommodated through one fastener-accommodating hole of the plurality of first fastener-accommodating holes in the fourth post, the first fastener pivotally attaching said top tier shelf to the fourth post;

e) a second fastener accommodated through one fastener-accommodating hole of the plurality of first fastener-accommodating holes in the third post, the second fastener pivotally attaching said top tier shelf to the third post;

f) a third fastener accommodated through one fastener-accommodating hole of the plurality first fastener-accommodating holes in the first post, the third fastener being accommodated in the third fastener-accommodating hole defined in said top tier shelf and attaching said top tier shelf to the first post;

g) a fourth fastener accommodated through one fastener-accommodating hole of the plurality of first fastener-accommodating holes in the second post, the fourth fastener being accommodated in the fourth fastener-accommodating hole defined in said top tier shelf and attaching said top tier shelf to the second;

h) a first support chain having a first end fixed to the first side edge of said top tier shelf and a second end;

i) a second support chain having a first end fixed to the second side edge of said top tier shelf and a second end;

j) a winding winch unit mounted on said frame unit and connected to said first support chain and to said second support chain;

k) an extension platform which includes (1) a first side edge, (2) a second side edge, (3) a first end edge, (4) a second end edge, (5) a width dimension measured between the first side edge of said extension platform and the second side edge of said extension platform, the width dimension of said extension platform being equal to the width dimension of said top tier shelf, (6) a first surface which is a top surface when said extension platform is in a use orientation, (7) the first end edge of said extension platform being fixedly connected to the first end edge of said top tier shelf when said extension platform is in the use orientation; and l) a plurality of support wheels which include (1) a first support wheel on the first end of the first post of said frame unit, (2) a second support wheel on the first end of the second post of said frame unit, (3) a third support wheel on the first end of the third post of said frame unit, and (4) a fourth support wheel on the first end of the fourth post of said frame unit.

* * * * *